US006244979B1

(12) United States Patent
Wu

(10) Patent No.: US 6,244,979 B1
(45) Date of Patent: Jun. 12, 2001

(54) MOUNTING STRUCTURE FOR A PITCHING PRACTICE DEVICE

(76) Inventor: Wan-Hsiang Wu, No. 10, Lane 69, Wei-Swei W. Road, Kang-Shang Tseng, Kaoshiung Hsien (TW)

( * ) Notice: Subject to any disclaimer, the term of this patent is extended or adjusted under 35 U.S.C. 154(b) by 0 days.

(21) Appl. No.: 09/481,560

(22) Filed: Jan. 11, 2000

(51) Int. Cl.[7] ..... A63B 67/00

(52) U.S. Cl. ..... 473/455; 273/371; 73/493; 403/300; 356/28; 473/156

(58) Field of Search ..... 434/21–23; 473/455, 473/456, 151–156, 190–199; 273/371, 374, 377; 403/353, 300, 306, 292, 315, 291; 24/313, 300, 482; 267/179, 270, 277; 73/488, 493; 356/27, 28

(56) References Cited

U.S. PATENT DOCUMENTS 2,556,117 * 6/1951 Smith et al. ..... 24/656
3,332,117 * 7/1967 McCarthy ..... 403/315
4,563,005 * 1/1986 Hand et al. ..... 273/371
4,850,084 * 7/1989 Iwasaki ..... 403/353
5,626,526 * 5/1997 Pao et al. ..... 473/156
5,779,241 * 7/1998 D'Costa et al. ..... 273/371
5,820,496 * 10/1998 Bergeron ..... 273/371
5,988,645 * 11/1999 Downing ..... 273/348

* cited by examiner

*Primary Examiner*—Jeanette Chapman
*Assistant Examiner*—Mitra Aryanpour
(74) *Attorney, Agent, or Firm*—Rosenberg, Klein & Lee

(57) ABSTRACT

A pitching practice device includes a frame with four sides and a net portion composed of longitudinal and latitude strings is defined within the frame. Each string has an end connected to a connection member and the other end of the string is connected to a handle. Each connection member is connected to a spring and an emitting member is connected to the connection member. Each connection member is received in a tube fixedly located in the frame and has a receiving member. When the strings are hit by a ball, the emitting members send a message to the corresponding receiving members to calculate the speed of the ball by the displacement of the strings.

5 Claims, 6 Drawing Sheets

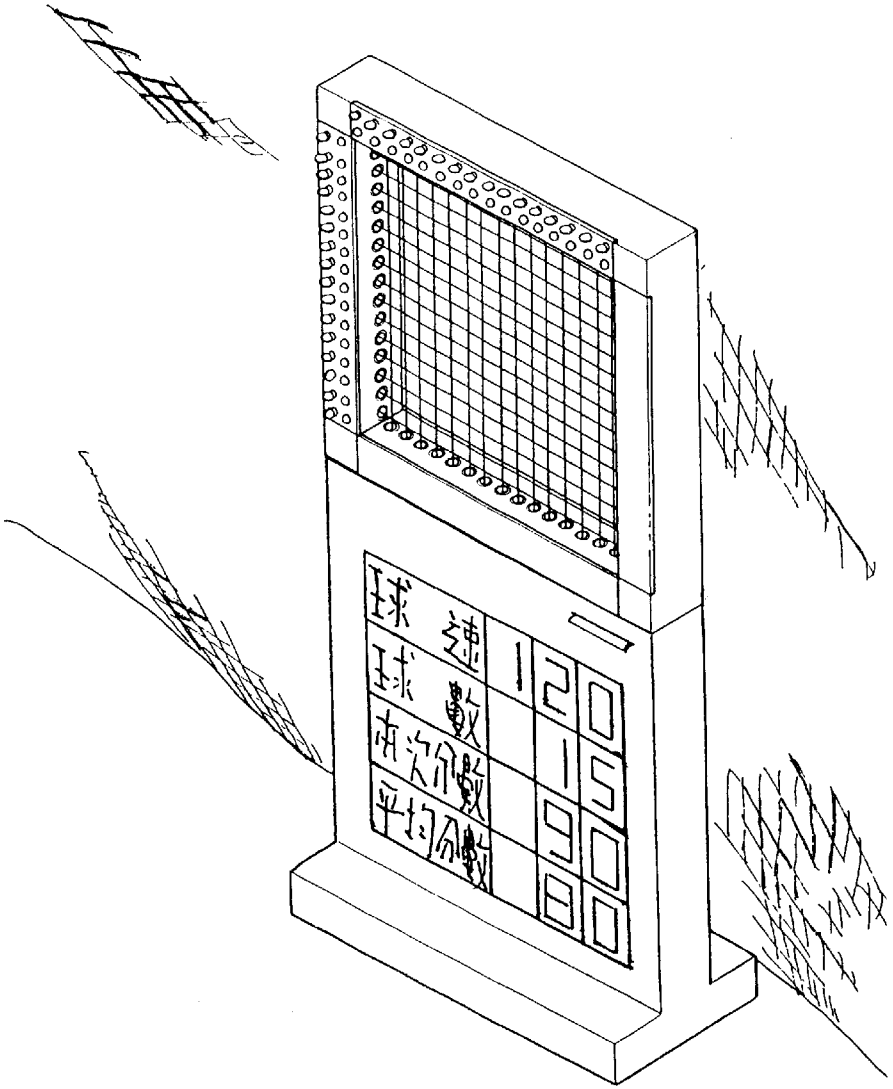
FIG. 6
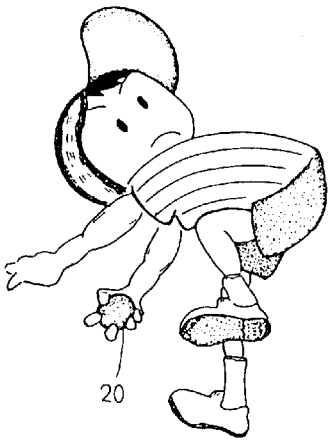

MOUNTING STRUCTURE FOR A PITCHING PRACTICE DEVICE

FIELD OF THE INVENTION

The present invention relates to a pitching practice device which includes a net portion and each string composing the net has its own detecting means to detect the displacement and the velocity of the ball.

BACKGROUND OF THE INVENTION

A conventional pitching device known to applicant is disclosed in Taiwanese utility patent application No. 88206273 and includes a frame with four sides. One of any two opposite sides of the frame has a plurality of emitting devices and the other side has receiving devices. The emitting devices each emit infrared rays to the corresponding receiving device on the opposite side so as to define a plurality of longitudinal rays and latitude rays, which define a net portion. The pitcher is required to pitch a ball through the frame and when the ball passes through the net portion, some of the infrared rays are interrupted so that the information is transferred to a CPU to display scores on a display board. However, the infrared rays emitting devices or the receiving devices are expensive so that the price of the pitching practice device will not be affordable for general players. Furthermore, the display board cannot show the velocity of the ball.

The present invention intends to provide a pitching practice device which includes simple parts and deformable strings so that when balls hit the strings, the displacement provides efficient data for the CPU to calculate the speed of the balls.

SUMMARY OF THE INVENTION

In accordance with one aspect of the present invention, there is provided a pitching practice device and comprising a frame having four sides, and a plurality of longitudinal strings and latitude strings connected between the four sides of the frame. Each side of the frame has two side members, a front member and a rear member. Each string is connected between a handle and a connection member. A plurality of first tubes extend through the side member on one side and a plurality of second tube extend through the side member on the other side. Each of the first tube and the second tube have a passage defined longitudinally therethrough. A receiving member is connected to an inside of each first tube and each connection member has an emitting member connected to a first end thereof and the emitting member is located in the passage of the first tube. A second end of each connection member is connected to a spring which is fixedly connected to the side member next to the first tube.

The object of the present invention is to provide a pitching practice device that has a net portion composed of strings each of which is deformable so that the speed of the ball can be calculated by the displacement of the strings.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 6 is an illustrative view to show the device of the present invention.

DETAILED DESCRIPTION OF THE PREFERRED EMBODIMENT

Figure 1:
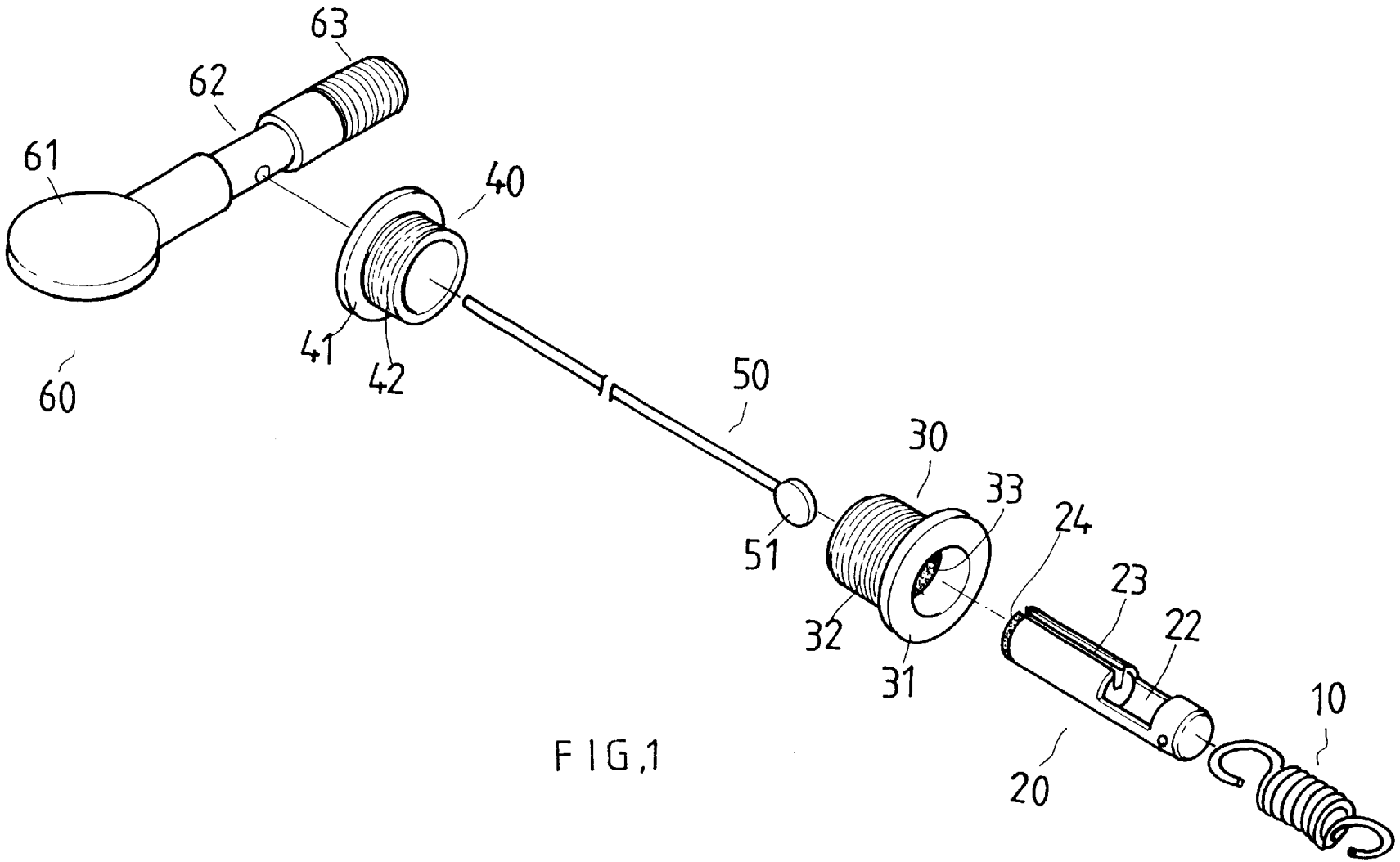
FIG. 1 is an exploded view to show the assembly of the strings which define the net portion of the device of the present invention.
Figure 2:
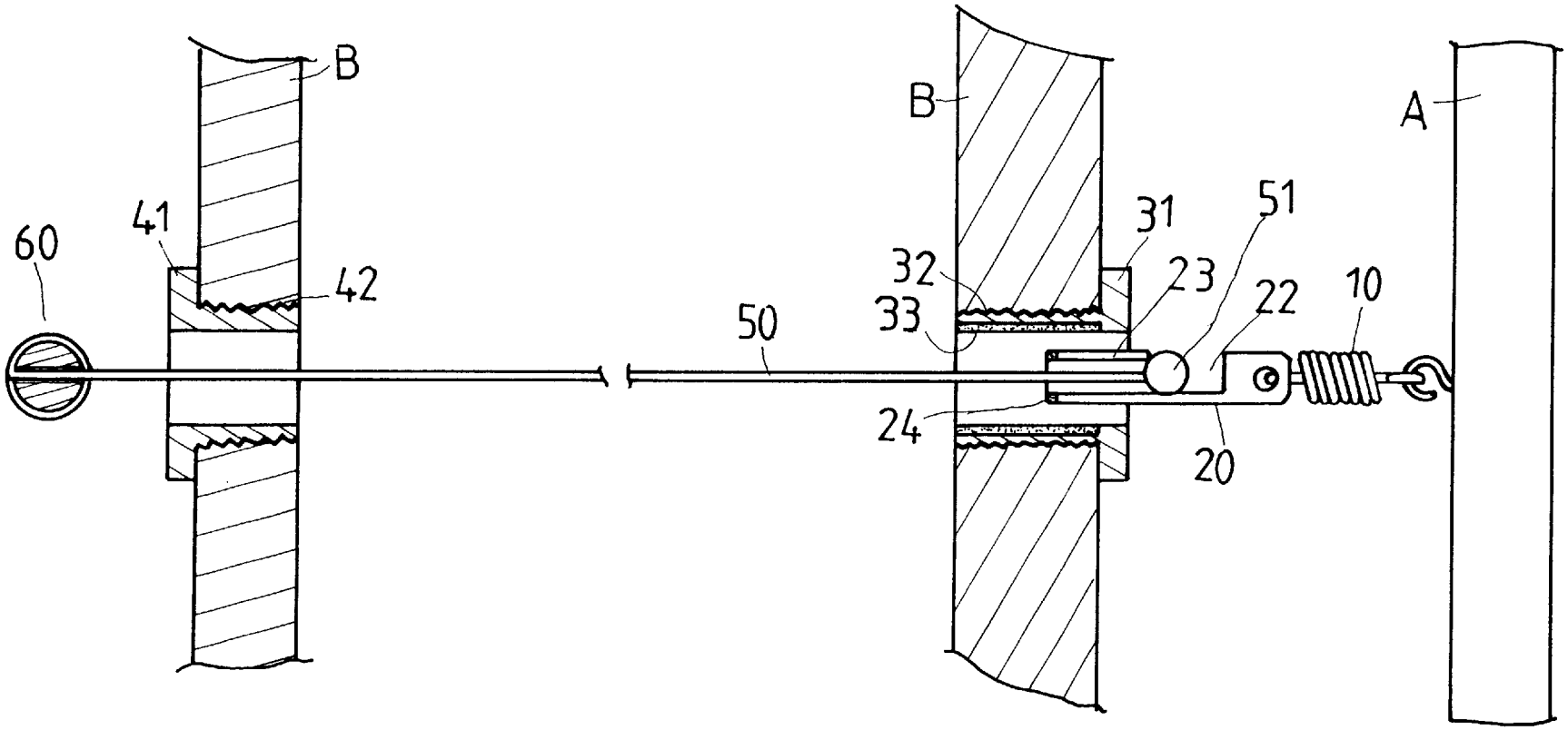
FIG. 2 is an illustrative view to show the assembly of the strings connected between two opposite sides of the frame of the device of the present invention.
Figure 3:
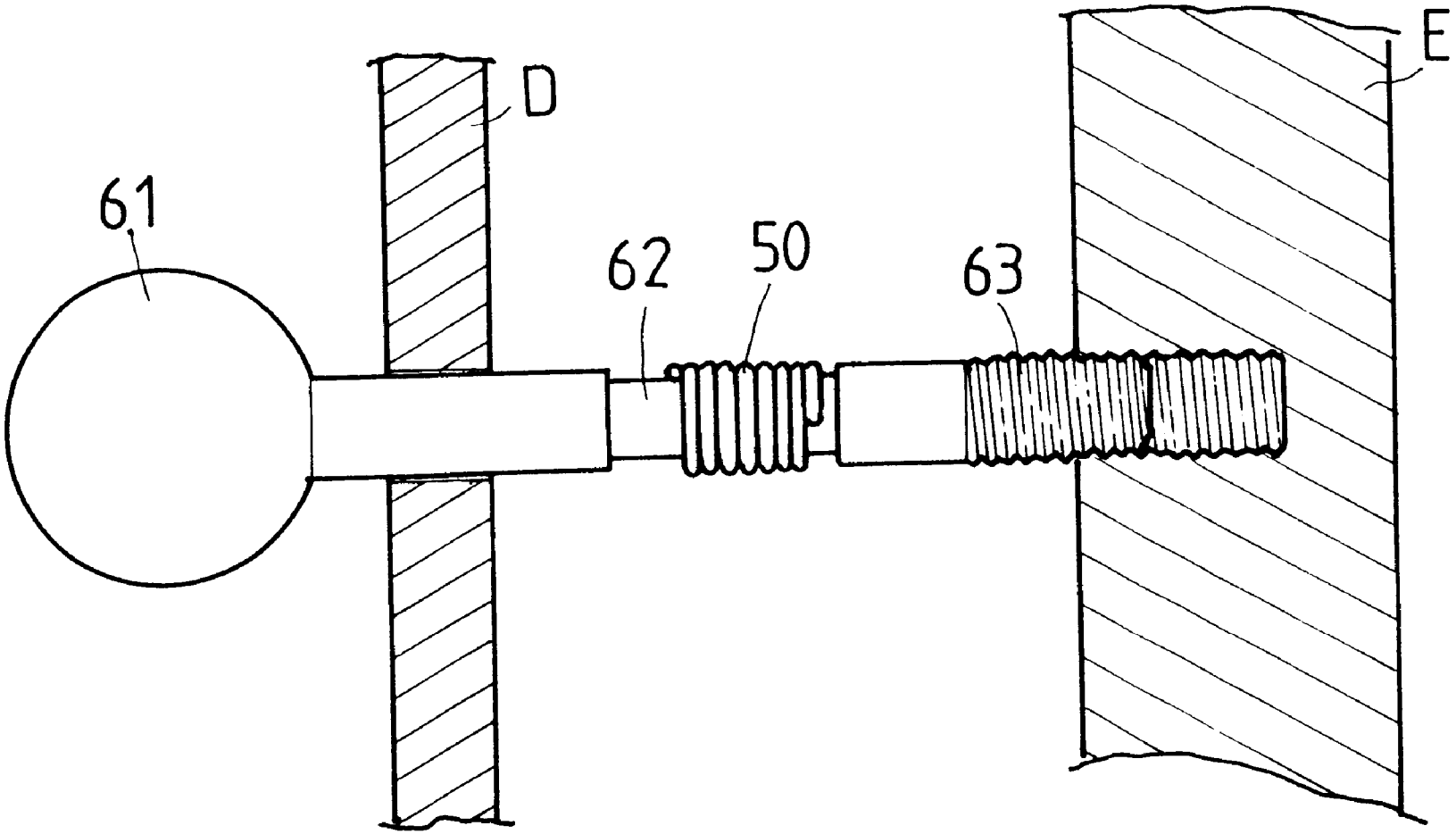
FIG. 3 shows that a handle on an end of a string is connected to the frame of the device of the present invention.
Figure 4:
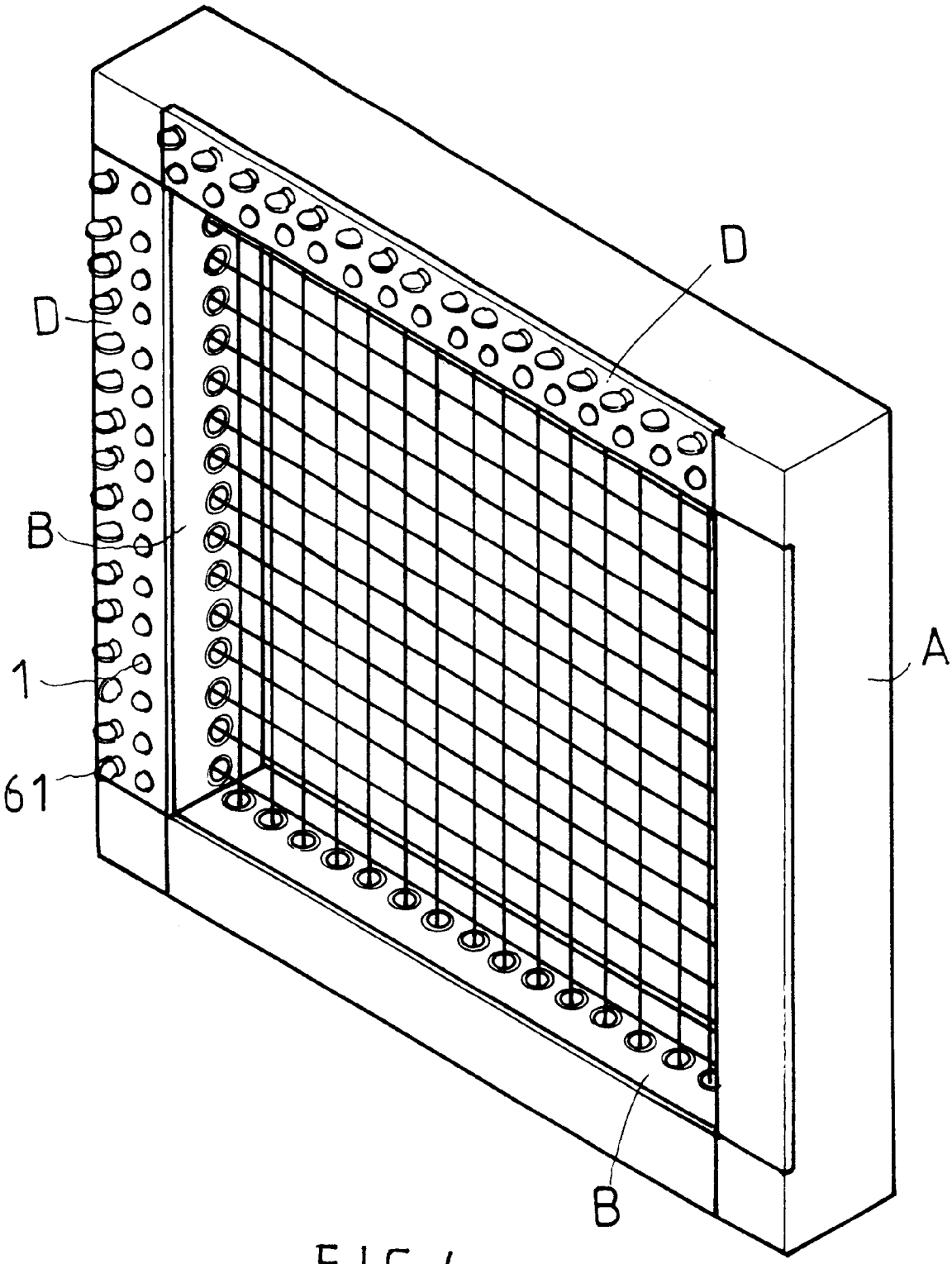
FIG. 4 is a perspective view to show the frame of the device.

Referring to FIGS. 1 to 4, the pitching practice device in accordance with the present invention comprises a rectangular frame having four sides. A net portion is defined in the frame and is composed of a plurality of longitudinal and latitude strings 50 connected between the four sides of the frame. Each side is an enclosed rectangle and includes two side members A and B, and a front member D and a rear member E. Each string 50 is connected between a connection member 20 on one side and a handle 60 on the other side of the frame. A plurality of first tubes 30 each have a threaded section 32 and the first tubes 30 threadedly extend through the member B on one side. A plurality of second tube 40 each have a threaded section 42 and the second tubes 40 extend through the member B on the other side. The first tubes 30 and the second tubes 40 each have a flange 31/41 extending radially outward from one of two ends thereof so that when the first tubes 30 and the second tubes 40 extend through the two members B, the flanges 31, 41 are engaged with the members B.

Each of the first tubes 30 and each of the second tubes 40 have a passage defined longitudinally therethrough and a receiving member 33 is connected to an inside of each first tube 30. Each connection member 20 has an emitting member 24 connected to a first end thereof and the emitting member 24 is located in the passage of the first tube 30. A second end of each connection member 20 is connected to a spring 10 which is fixedly connected to the member A next to the first tube 30.

Each handle 60 has a hole defined radially therethrough so that an end of the string 50 extends through the hole and is wrapped around the handle 60. Each handle 60 has a knob 61 on one end thereof and the other end of the handle 60 is a threaded end 63 so that the handle 60 extends through the front member D and is threadedly engaged with the rear member E. The tension of each string 50 can be adjusted by rotating the knob 61 and a light 1 is located beside the knob 61 so as to indicate the condition of the string 50. If the tension of the string 50 meets the pre-determined value, the light is green, and if the tension of the string 50 does not meet the pre-determined value, the light is red. Each connection member 20 has a recess 22 defined radially therein and a slit 23 is defined in an outside of each connection member 20. The slit 23 communicates with the recess 22 and the string 50 is received in the slit 23. An end of each string 50 has a head 51 which is received in the recess 22.

Figure 5:
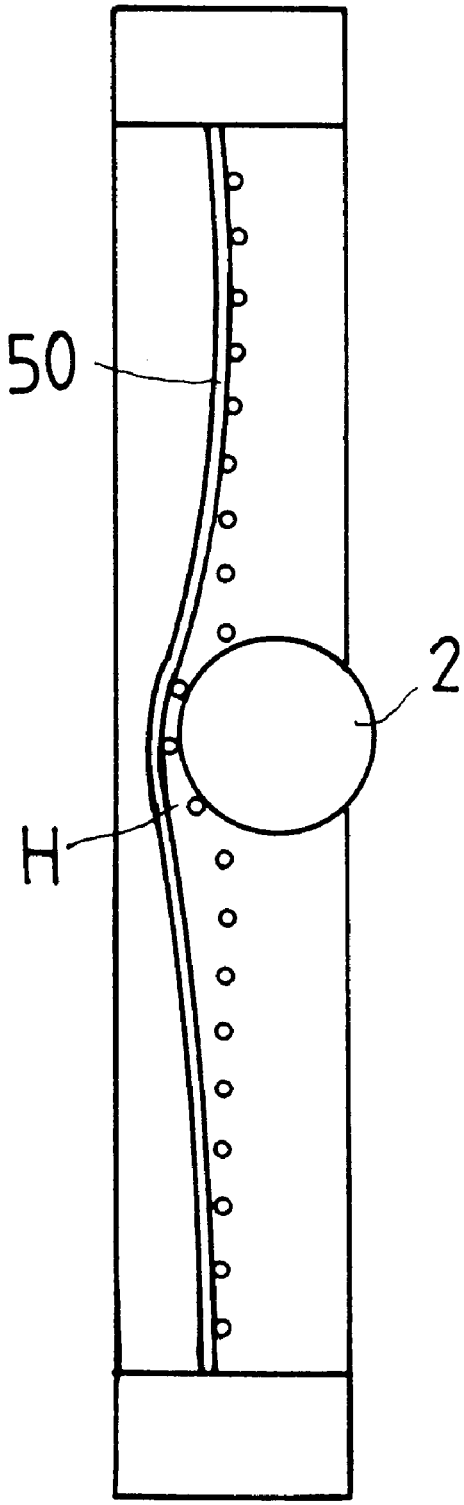
FIG. 5 is an illustrative view to show that the string is deformed when a ball hits the string.

Referring to FIGS. 5 and 6, when a ball 2 hits the strings 50, the emitting members 24 send a message to the receiving member 33 to obtain information of the time that the ball 2 hits the strings 50 and the force applied to the strings 50. The strings 50 are deformed by a displacement "H" and the speed of the ball 2 can be calculated according to the displacement "H".

The device of the present invention has a simple structure and provides a lot of information of the ball 2 hitting the strings 50 to the players.

While we have shown and described various embodiments in accordance with the present invention, it should be clear to those skilled in the art that further embodiments may be made without departing from the scope and spirit of the present invention.

What is claimed is:

1. A pitching practice device comprising:

a frame having four sides;

a plurality of longitudinal strings and latitude strings connected between said four sides of said frame, each side having two side members, a front member and a rear member, each string connected between a handle on one side and a connection member on the other side, a plurality of first tubes extending through said side member on one side and a plurality of second tube extending through said side member on the other side, each of said first tubes and each of said second tubes having a passage defined longitudinally therethrough and a receiving member connected to an inside of each first tube, each connection member having an emitting member connected to a first end thereof and said emitting member located in said passage of said first tube, a second end of each connection member connected to a spring which is fixedly connected to said side member next to said first tube.

2. The device as claimed in claim 1, wherein each handle has a hole defined radially therethrough so that an end of said string extends through said hole and is wrapped around said handle.

3. The device as claimed in claim 2, wherein each handle has a knob on one end thereof.

4. The device as claimed in claim 1, wherein each connection member has a recess defined radially therein and a slit is defined in an outside of each connection member, said slit communicating with said recess and said string received in said slit, an end of each string having a head which is received in said recess.

5. The device as claimed in claim 1, wherein said first tubes and said second tubes each have a flange extending radially outward from one of two ends thereof.

* * * * *